United States Patent [19]

Snead et al.

[11] Patent Number: 4,795,301

[45] Date of Patent: Jan. 3, 1989

[54] LOW-CENTER-OF-GRAVITY SELF-UNLOADING TRAIN FOR BULK COMMODITIES

[76] Inventors: Edwin deS Snead; William B. Snead, both of P.O. Box 1000, Georgetown, Tex. 78626

[21] Appl. No.: 905,662

[22] Filed: Sep. 11, 1986

[51] Int. Cl.[4] ..... B65G 21/00

[52] U.S. Cl. ..... 419/339; 414/520; 414/528

[58] Field of Search ..... 414/339, 343, 352, 353, 414/519, 520, 527, 528, 502–505, 786; 105/239; 104/2; 198/825, 829, 830, 317

[56] References Cited

U.S. PATENT DOCUMENTS

| | | | |
|---|---|---|---|
| 2,030,553 | 2/1936 | Tiley | 414/520 |
| 2,420,009 | 5/1947 | Osgood | 414/528 |
| 2,805,759 | 9/1957 | Manleau | 198/317 X |
| 2,971,631 | 2/1961 | Gray | 198/303 |
| 3,220,355 | 11/1965 | Jones | 414/339 X |
| 3,272,357 | 9/1966 | Freni | 414/339 |
| 3,355,041 | 11/1967 | O'Leary | 414/339 X |
| 3,612,257 | 10/1971 | Goergen | 198/830 X |
| 3,986,708 | 10/1976 | Helteel et al. | 414/502 |
| 4,173,422 | 11/1979 | Baker | 414/520 |

FOREIGN PATENT DOCUMENTS

| | | | |
|---|---|---|---|
| 2451518 | 6/1976 | Fed. Rep. of Germany | 414/527 |
| 730300 | 5/1955 | United Kingdom | 414/528 |

*Primary Examiner*—Peter A. Aschenbrenner
*Attorney, Agent, or Firm*—Dula, Shields & Egbert

[57] ABSTRACT

A unit train consists of a plurality of hopper cars and a multi-purpose trailer car. The hopper cars have one or more hoppers each having a bottom discharge opening and a controller gate. The hopper cars are constructed with load bearing side sills to provide an unobstructed longitudinal channel immediately above the wheel axles and between the wheels. An endless belt conveyor traverses the length of the train including a portion of the trailer car within those car channels, and underlies the hopper discharge gates so that the hoppers may be emptied sequentially onto the train conveyor to unload the entire train. The trailer car includes a lift portion of the train conveyor to elevate the material for discharge onto a transfer conveyor carried on the trailer car. The elongated transfer conveyor is pivotally mounted at the receiving end to be swung laterally to discharge the material received from the train conveyor at some selected point relative to the trailer car. The trailer car may include the power system and control systems for operating the conveyors and the hopper gates. The train is self-unloading by depositing the train load in a windrow alongside the track while the train is moving slowly. For unloading the train in a stationary position, the transfer conveyor may deposit the material onto a portable stacking conveyor which may then deposit the entire train load in one or more stockpiles located some distance from the track.

13 Claims, 7 Drawing Sheets

LOW-CENTER-OF-GRAVITY SELF-UNLOADING TRAIN FOR BULK COMMODITIES

BACKGROUND AND SUMMARY OF THE INVENTION

This invention relates to the transporting of bulk commodities by train, which train has on-board facilities for unloading the bulk commodities; and more particularly to such train having a conveyor running its entire length and supported between the train wheels for receiving the commodities from overlying hoppers, and discharging them at one end of the train.

Rail transportation is generally recognized as being more economical than truck transportation for bulk commodities such as aggregates. Large quantities of such commodities can be moved by a small crew at low cost. However, rail transportation frequently loses out in competitive situations because of the cost of unloading, stock piling, and delivering the commodity to the ultimate destination.

Even though large quantities of bulk material can be transported at low cost from one terminal to another, the burden is placed on the unloading facility to maintain the economics of this method of transportation for the purchaser of the commodity. If the unloading is slow, and the train is therefore delayed for a substantial period of time for the unloading to be accomplished, there is an added investment cost per ton handled for the use of the railroad equipment. One problem, in this regard, is that rail transportation is a 24-hour operation while many of the industries it serves operate only during daylight hours. Often a train makes good speed from origin to destination, only to be delayed several hours waiting to be unloaded. Each hour of delay adds to the transportation cost as much as an additional 25 to 50 miles of haul.

As an example of the efficiency of rail transport for bulk commodities, a train with a two-man crew pulling 1600 net tons at 55 miles per hour would be producing 32 times as many ton-miles per hour as a dump truck driver hauling 25 tons at 55 miles per hour.

Another problem effecting the efficiency of rail transportation for bulk commodities is that, under current methods, the quick unloading of a commodity train requires high capacity equipment and facilities which are idle most of the time. Such high capacity equipment and facilities are expensive, and add significantly to the investment cost per ton handled.

The following are some of the methods which are currently used for the unloading of bulk materials from trains.

Bottom dumping hopper cars are equipped with automatic doors that are opened automatically as the cars move over a pit, where the pit facility includes a feeder and a conveyor. Either a pit or an elevated trestle is required for this method, so that this method is ruled out at many locations. Obviously the providing of a pit or trestle facility with associated conveyor systems is expensive.

Another method involves the use of rotary car dumpers; and these are commonly used for unloading coal at electric generating plants. Again, the equipment for unloading the cars is highly specialized and expensive.

Side dumping cars have been used for many years, but cannot be dumped on level ground. They require elevated track on a built up embankment for example, so that the dumped material will flow over the side of the embankment and not flow back over the track.

Finally, backhoes or other unloading equipment are used to unload standard gondola cars. These methods are generally slow, promoting the delay problems mentioned above.

To take maximum advantage of the efficiencies of rail transportation, a special type of train is needed to deliver bulk commodities on any track, at any time of the day or night, with no labor required other than the train crew. Such a train would make optimum use of labor while providing incentive wages for the crew, and thereby reduce overall labor costs.

A self-unloading train which overcomes many of the above discussed disadvantages of rail transportation for bulk materials may be a "unit train" consisting of a plurality of hopper cars and a trailer car, the unit train to be pulled by a conventional locomotive.

Each of the hopper cars may include several hoppers having bottom discharge openings and associated gates for discharging onto an endless belt conveyor which runs the entire length of the train. The trailer car includes a transfer conveyor which receives the material from the train conveyor, and is movable on the trailer car to transfer the material to a selected point relative to the train.

With the unit train moving along a straight section of track, the material may be deposited in a windrow along side track by the transfer conveyor. Alternatively, the unit train may be unloaded while stationary, with the transfer conveyor discharging onto a portable stacking conveyor, for example, which will enable the deposit of the material in piles thirty feet high at least forty feet away from the track for example.

Applicants are co-inventors of a generally similar train having an on-board belt conveyor which runs the length of the train for receiving bulk materials from overlying hoppers. The earlier train design was developed to modify existing standard gondola cars, the structure of which included conventional center sills, couplings, bolsters, and two-axle trucks. Railcars of this design modified to include hoppers overlying the conveyor belt are able to carry the maximum allowable gross weight of a material such as crushed limestone, weighing about 85 pounds per cubic foot, with the center of gravity of the loaded railcar being maintained below the 96 inch limit.

It is desirable to use a train according to the applicant's earlier invention for carrying coal, for example, which weighs about 50 pounds per cubic foot. For a hopper car as above described to carry the allowable gross weight of coal, the hopper walls could be raised to carry more volume, but this type of modification would quickly raise the center of gravity above the 96 inch limit.

As an alternative to raising the height of the hopper walls, longer cars could be constructed. For example, rather than using a car having a length of 56 feet, the length of a standard gondola car, a car could be designed having a length of 90 feet for example. However, cars of this length create maneuvering and clearance problems, and require that the train have a longer straight track available for unloading. Trains of this type having a train length belt conveyor must be positioned on a straight section of track when the conveyor belt is being operated to discharge the load.

A much more desirable solution is to design a train including hopper cars wherein the load may be carried lower, enabling the height of the hopper cars to be increased without exceeding the 96 inch center of gravity height limit for the loaded cars in the United States of America.

An object of this invention is to provide improved equipment and methods for the rail transport and unloading of bulk materials.

Another object of this invention is to provide such improved equipment and methods whereby the unloading may be accomplished by the train crew at any time of the day or night, thereby eliminating idle time of the train equipment while waiting for the opening of an unloading facility or while waiting for the arrival of material receiving equipment or vehicles.

A further object of this invention is to provide such equipment and methods wherein the unloading does not require highly specialized and expensive unloading facilities or equipment.

Still another object of this invention is to provide such apparatus and methods wherein the unloading of the train may be accomplished efficiently in a very short time.

Another object of this invention is to provide such equipment and methods to minimize the expense of unloading bulk material from a transport train.

Another object of this invention is to provide such equipment and methods wherein the equipment includes selfunloading apparatus.

A still further object of this invention is to provide such equipment and methods wherein the equipment is a unit train having a train length conveyor.

Still another object of this invention is to provide such equipment and methods which take advantage of the efficiency of rail transportation by eliminating the need for a specialized unloading facility.

Another object of this invention is to provide such improved equipment and methods which enables the use of deeper hoppers to allow transport of the maximum allowable net load of lighter bulk commodities, while maintaining the required center-of-gravity height limit.

A further object of this invention is to provide such improved equipment and methods including a side sill car structure, enabling the bases of the hoppers to be located closer to the rails.

These objects are accomplished broadly in a train formed from a plurality of coupled hopper cars. Each hopper car is constructed to include a pair of side sills extending the length of the car for carrying the car load. The side sills are joined together by car structure providing an unobstructed longitudinal channel between the hopper car wheels and immediately overlying the wheel axles. A train conveyor, including a supply run and a return run, traverses the channel and extends the length of the train to discharge the material at the end of the train. The return run is supported immediately above the wheel axles. Troughing idlers are supported immediately above the return run for supporting the supply run. Each of the hopper cars includes at least one hopper having walls inclined at shallow angles from vertical to a bottom discharge opening, for gravity discharge of the bulk material to the train conveyor. Each of the hoppers includes for its discharge opening which are operable selectively to discharge the material from the hoppers onto the train conveyor.

These objects are also accomplished in a method which includes the following steps. Bulk material is loaded onto a train including a plurality of hopper cars, each having one or more hoppers. The hopper cars are constructed to include a pair of side sills extending the length thereof for carrying the car load, and providing an unobstructed longitudinal channel between the hopper car wheels and immediately overlying the wheel axles. The hoppers are formed with walls inclined at shallow angles from vertical to bottom discharge openings, for gravity discharge of the bulk material. The bulk material is discharged from the hoppers by means of discharge gates associated with the discharge openings. The material is conveyed from the hoppers to the end of the train, and discharged from the train, by means of a train conveyor traversing the length of the train within the channel.

The novel features and the advantages of the invention, as well as additional objects thereof, will be understood more fully from the following description when read in connection with the accompanying drawings.

DRAWINGS

DESCRIPTION OF THE PREFERRED EMBODIMENT

Figure 1:
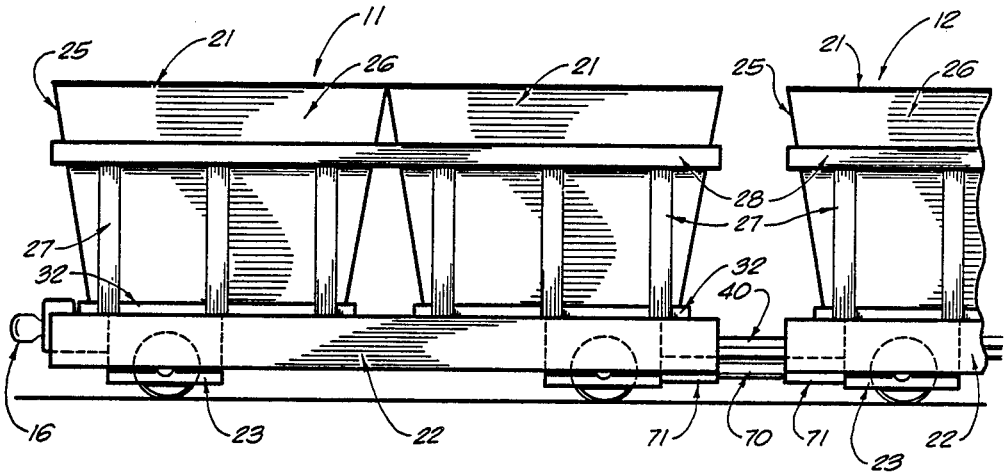
FIG. 1 is a side view of a portion of a train according to the invention.
Figure 2:
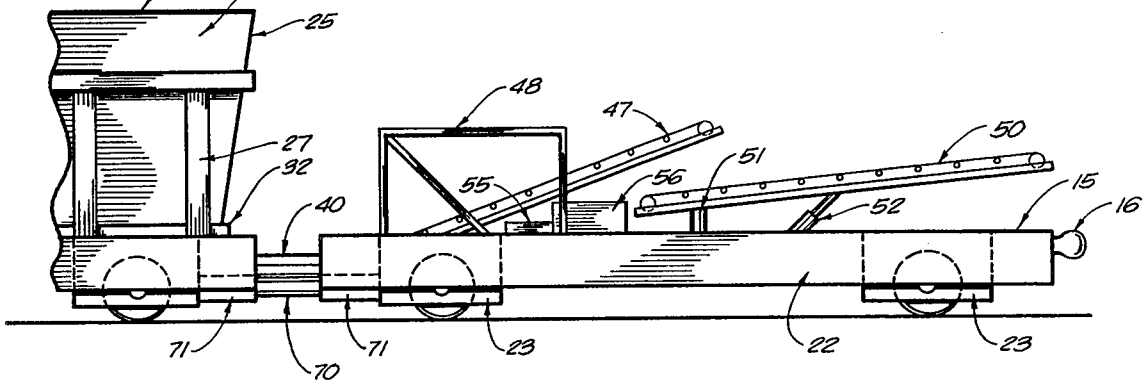
FIG. 2 is a side view of another portion of a train according to the invention, including a trailer car.

FIGS. 1 and 2 of the drawing are diagrammatic side views of a self-unloading train according to the invention. FIG. 1 illustrates hopper cars 11 and 12 which are the front cars of the train; and FIG. 2 illustrates cars 14 and 15 which are the rear cars of the train. The train, according to the invention, may be referred to as a "unit train", in the sense that the cars of the train are permanently coupled together, and would not be uncoupled unless it is necessary to remove one of the cars to a service facility. The cars of the unit train are preferably coupled together by special couplers which will be described. The front end of the front car 11 would have a standard coupler 16 for coupling to a standard locomotive; and by the same token the rear end of the trailer car 15 may have a standard coupler 16 for use in moving the train from its rear end.

A self-unloading train according to the invention may have any desired number of cars; and the cars may have any desired number of hoppers, two hoppers for each car being illustrated in the drawing. Each hopper has a bottom discharge opening and an associated discharge gate. The hopper cars are designed to support a train conveyor, illustrated as an endless belt conveyor, which traverses the length of the train including the hopper cars and a portion of the trailer car. This train conveyor underlies the discharge gates of the several hoppers to receive the material discharged through these gates and carry that material to one end of the train.

Figure 3:
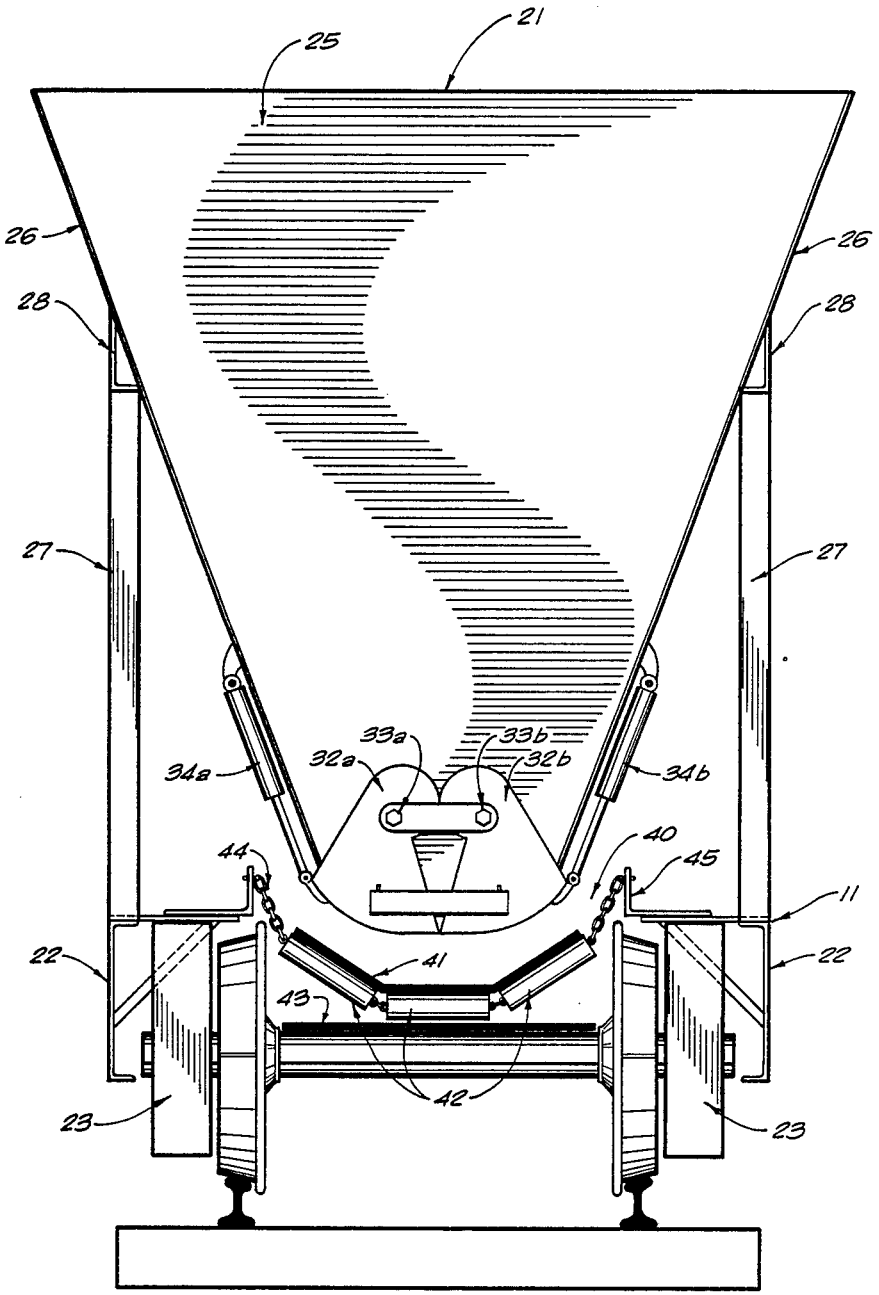
FIG. 3 is a transverse sectional view of a hopper car illustrated in FIG. 1.

FIG. 3 is a diagrammatic cross-sectional view of a typical hopper car 12, the section being taken through one of the hoppers 21 of the hopper car. As seen in these figures, the hopper car frame includes a pair of side sills 22 which extend the length of the car, and are interconnected in parallel relation by support structure which is not shown. These side sills may have the form of elongated structural channels; and the side sills are supported on single axle truck units 23 adjacent to each end of the car. By way of example, the single axle truck units may be the National Single Axle Unitruck II, manufactured by Midland Ross Corporation. For this car structure, the side sills support the entire carload, including the entire weight of the car and its carried load, and also the draft load. As best seen in FIG. 3, the car frame is constructed to provide an unobstructed longitudinal channel between the wheels of the trucks 23 and extending vertically from a plane immediately above the wheel axles to a plane somewhat above the upper edges of the wheels. This unobstructed channel accommodates the train conveyor, as will be described subsequently.

The hopper body 21 may be rectangular as viewed from the top, including planar end walls 25 and planar side walls 26. The hopper walls are inclined at shallow angles to the vertical to effect complete discharge of all material by gravity, with both the end walls and the side walls being inclined no more than 25° from the vertical. The hoppers are supported directly from the side sills 22 by vertical posts 27 which bear on longitudinal stringers 28 suitably secured to the side walls.

The bottom discharge opening 31 of the hopper is quite long and quite wide, and is closed by a suitable clamshell gate consisting of a pair of coacting gate members **32*a* and 32*b* pivotally mounted for movement between the illustrated closed position and an open position, the pivot axes 33*a* and 33*b* for the gate members being parallel to the train conveyor. The two gate members 32*a* and 32*b*** will be quite long and narrow, the length of these gate members being at least 80% of the longitudinal top dimension of the associated hopper. In the open position of the gate members, the gate opening should have a width of at least 30 inches, in relation to the approximate distance between the truck wheels of 53 inches. The width of the hopper discharge opening defined by the maximum opening of the gate members, then, should be at least 58% of the distance between the interior faces of the truck wheels.

The clam-shell gate members **32*a* and 32*b* are preferably operated between the closed and open positions by power means such as hydraulic cylinders 34*a* and 34*b*. Preferably each gate member would be powered by two such hydraulic cylinders, connected between the gate members and the side walls of the hopper as best seen in FIG. 3. Preferably the hydraulic cylinders 34*a* and 34*b*** would be double-acting cylinders controlled by suitable four-way control valves. Such control valves may be manual valves suitably mounted on the car structure, to enable an operator to move along side the unit train and open the gates for the several hoppers sequentially.

The train conveyor 40 is illustrated as an endless belt conveyor consisting of an upper supply run 41 and a lower return run 43. As seen in FIG. 3, the belt is quite wide, and it desirably has the widest possible width in relation to the maximum width of the conveyor channel, approximately 53 inches. The conveyor width of course should be substantially greater than the maximum opening width of the hopper gates, namely 30 inches. The return run 43 of the conveyor belt is supported generally in a plane disposed as close as possible to the upper surfaces of the wheel axles, as best seen in FIG. 3; and this return run may be supported by suitable return idlers (not shown). The upper run 41 of the belt is supported by suitable troughing idlers 42. In order to support the upper run as low as possible, and therefore as close as possible to the return run, the troughing idlers 42 are supported in catenary fashion by chains 44, in turn supported by suitable brackets 45 secured to the side sills 22. With the train conveyor 40 so supported within its longitudinal conveyor channel, the center of gravity of the conveyor structure is as low as possible; and the bottoms of the hoppers 21 may be disposed, in turn, as low as possible, providing only the necessary clearance above the conveyor upper run 41 to allow the movement of material from the hoppers to the end of the train.

With the hopper walls being inclined as described, being inclined at relatively small angles to the vertical and defining discharge openings which are quite long and quite wide, the center of gravity of the load carried within the hopper is maintained lower to enable a heavier load to be carried in each hopper. The height of the hoppers may then be raised to enable the carrying of the maximum allowable car load of lighter material such as coal. According to calculations made by the applicant, for a hopper car as illustrated and described, the hopper height may be as much as 10 feet from gate to top, and the hopper may be loaded level full with coal (at about 50 pounds per cubic foot) without exceeding the 96 inch center of gravity limit for the loaded railcar which is prescribed for U.S. railroads.

As mentioned, the train conveyor 40 traverses the entire length of the hopper car portion of the unit train and a portion of the length of the trailer car 15 as best seen in FIG. 2. The adjacent cars of the unit train have suitable support structures for supporting the train conveyor over the car couplers.

The trailer car 15 is a multi-purpose car and, as best seen in FIG. 2, may consist of a flatbed car carrying certain structures to be described. The portion of the train conveyor 40 which is carried on the trailer car, is a lift portion 47 which elevates the conveyed material for discharge onto a transfer conveyor 50. This lift portion 47 is supported by a suitable frame structure 48 of the trailer car.

The transfer conveyor 50 is an elongated endless belt conveyor, having a length of about 30 feet for example, which is carried at the rearward end of the trailer car 15. The forward end of the transfer conveyor is mounted on a post 51 underlying the rearward end of the train conveyor 40, with the transfer conveyor being supported to rotate relative to the vertical axis of the post 51 to position its rearward discharge end at any desired point. During transit, the transfer conveyor is carried as illustrated in FIG. 2 in longitudinal alignment with the trailer car. The transfer conveyor is also pivotable, relative to the post 51, about a horizontal transverse axis, to that the rearward end of the conveyor may be elevated as desired; and this is accomplished by means of a hydraulic lift cylinder 52. The transfer conveyor is preferably provided with hydraulically powered means (not shown) for rotating the conveyor relative to the axis of the post 51. In this manner the discharge end of the transfer conveyor can be positioned where desired, to discharge the material from the train conveyor 40 into other transport vehicles, onto another conveyor, onto piles adjacent to the track, or onto the track behind the trailer car.

The trailer car 15 may also carry power generating apparatus for operating the conveyor system described. The train conveyor 40 and the transfer conveyor 50 are preferably driven by suitable electric motors; and the power for these motors may be generated by a suitable electric generator 55 driven by a suitable internal combustion engine 56 such as a diesel engine. The generator 55 may also provide power for auxiliary apparatus such as a portable stacking conveyor to be described. High pressure hydraulic fluid for the operation of the gate cylinders 34*a* and 34*b* may be supplied from the trailer car 15 which would include a suitable electric motor driven hydraulic pump. The electric motor would receive its energy from the above mentioned generator 55.

Preferably, the hoppers will be emptied in sequence beginning with the hopper nearest the trailer car. It is desirable that the hopper gates be operated under the manual and visual control of a crew member to assure that one hopper is completely empty before the gates of the succeeding hopper are opened. Where the load is being dumped in a windrow, this operator may also assist in controlling the speed of the train by signaling the locomotive enginer to assure the efficient stacking of the windrow.

The trailer car 15 may also include a suitable control panel or station for the operation and control of the several above described components including the generator 55, the generator driving engine 56, the motors for the train conveyor 40 and the transfer conveyor 50, the hydraulic mechanisms for both rotating and changing the height of the transfer conveyor, and possibly the mechanism for controlling the tension on the train conveyor 40.

Figure 8:
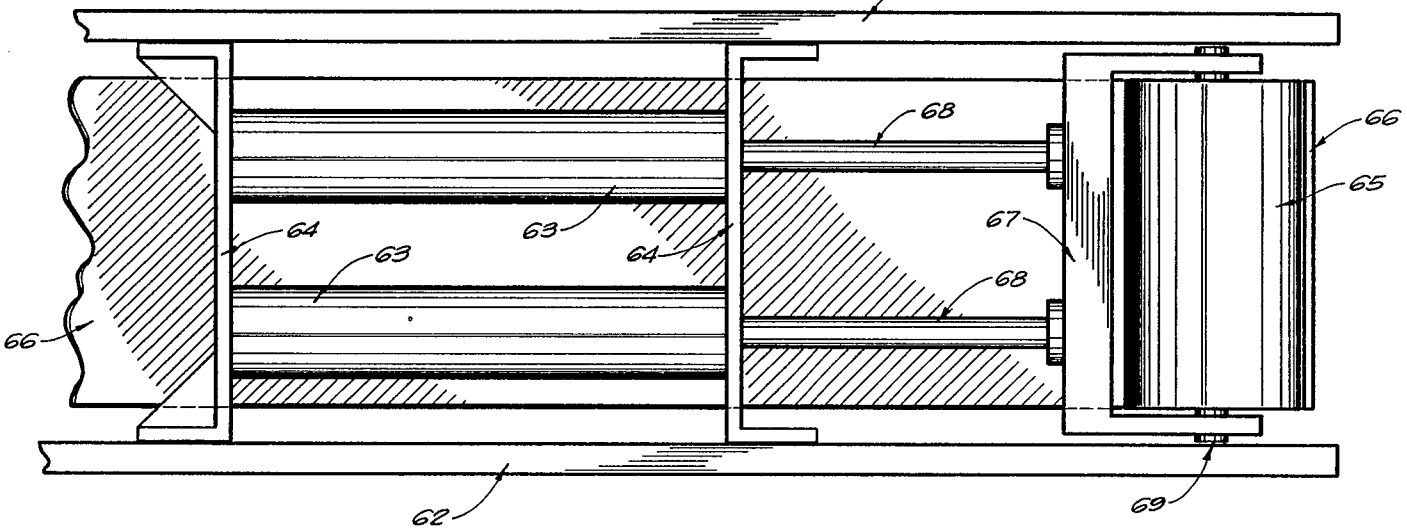
FIG. 8 is a diagrammatic illustration of a belt tensioning mechanism for the train conveyor.

For the operation of the train conveyor 40, the train must be on a straight section of track, since the conveyor belt cannot accommodate any curves during use. During such use the conveyor must be appropriately tensioned; and this may be accomplished by a suitable hydraulically controlled system which may be associated with the lift portion 47 of the conveyor carried on the trailer car 15. This belt tensioning system may be conventional; and a typical system is illustrated diagrammatically in FIG. 8. As seen in FIG. 8, the structure for the conveyor 40 may include side rails 62 for supporting the troughing and return idlers; and these rails also support a pair of hydraulic cylinder units 63 by means of brackets 64. The head (or tail) pulley 65 for the belt 66 is rotatably supported in a yoke 67, which is mounted on the piston rods 68 of the hydraulic cylinder units 63. It will be seen that extension of the piston rods 68 of the hydraulic cylinder units will cause the belt 66 to be tensioned, and that retraction of the piston rods will relax the tension and create slack in the belt. During the transit of the train, some slack must be imparted to the train conveyor to allow the belt to flex at the coupling points and enable the train to negotiate curves without damage to the belt. The control for that belt tensioning system may also preferably be included in the above mentioned control panel carried on the trailer car.

Figure 4:
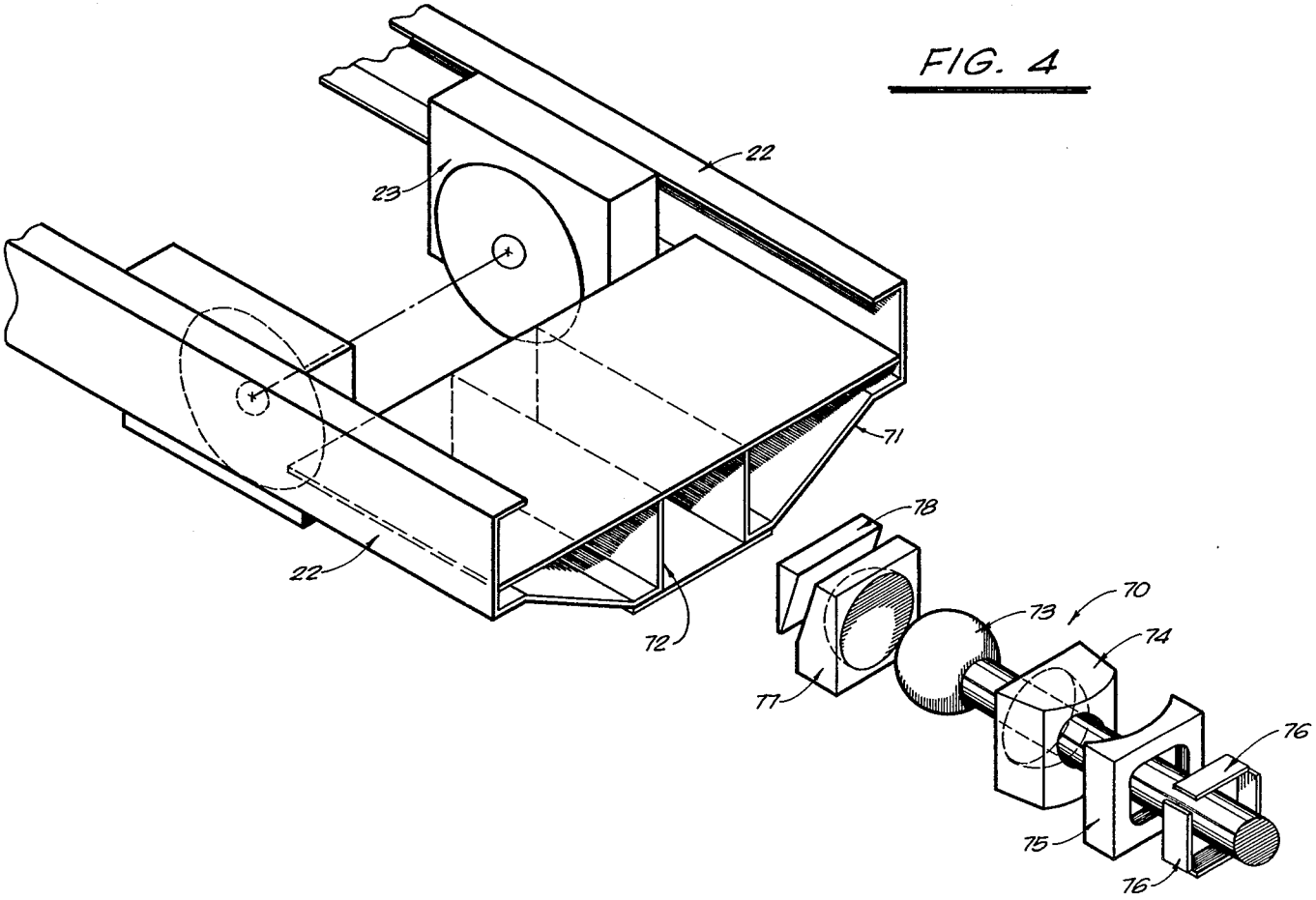
FIG. 4 is an exploded view of one form of coupler for a hopper car and associated support structure for the coupler.
Figure 5:
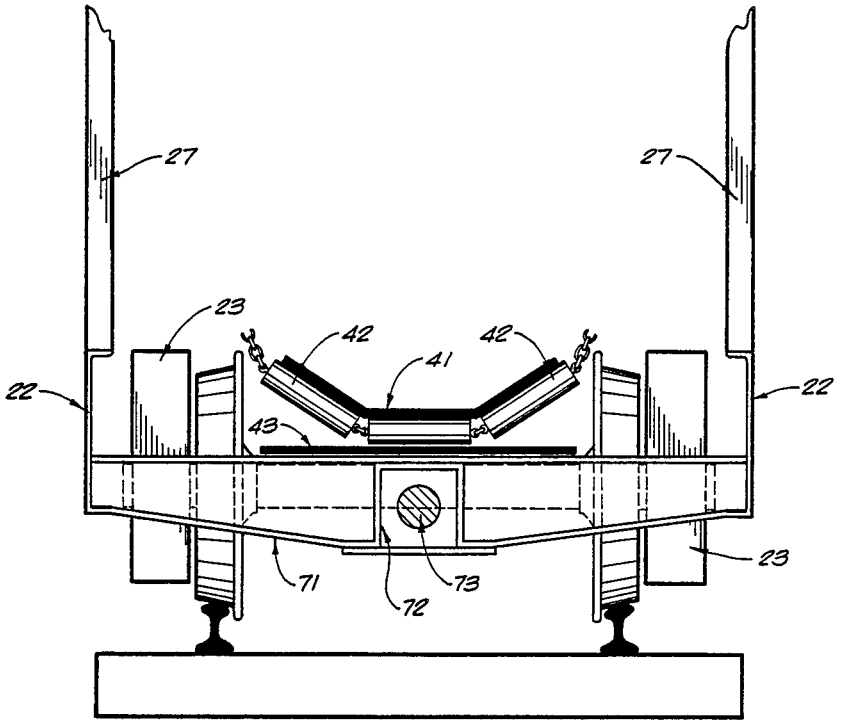
FIG. 5 is a fragmentary end view of a hopper car, illustrating the coupler and support structure of FIG. 4.

Because of the train conveyor 40 which spans the length of the train, it is desirable that the cars of the "unit train" be coupled together by means of couplers or coupling systems which are slackless or nearly slackless. One form of coupler system includes a drawbar assembly 70 and associated support structure 71 which are illustrated in FIGS. 4 and 5. The support structure 71 is secured, by welding for example, to the side sills 22; and functions as a shear-loaded assembly to transfer the draft load from the side sills to the coupler assembly. The support structure 71 defines a central longitudinal housing 72 for receiving and supporting the drawbar assembly 70. As best seen in FIG. 4, the drawbar assembly includes a drawbar unit 73 consisting of a cylindrical shank having an enlarged ball at either end. At each end the ball is seated in a draft block 74 which is, in turn, seated in a wear block 75. The draft block and wear block have mating cylindrical surfaces for relative rotation about a vertical axis. The wear block is retained within the channel 72 by means of draft stop lugs 76. The ball of the drawbar unit 73 is maintained seated in the draft block 74 by rear support block 77; and a slack adjustment wedge 78 maintains the draft block and the rear support block in the desired relation to prevent longitudinal movement of the drawbar unit relative to the support structure. The slack adjustment wedge coacts with suitable structural members of the housing 72. This described slackless coupler may allow angling of the drawbar unit to 7° up or down and up to 10½° left or right relative to the support structure 71.

Figure 6:
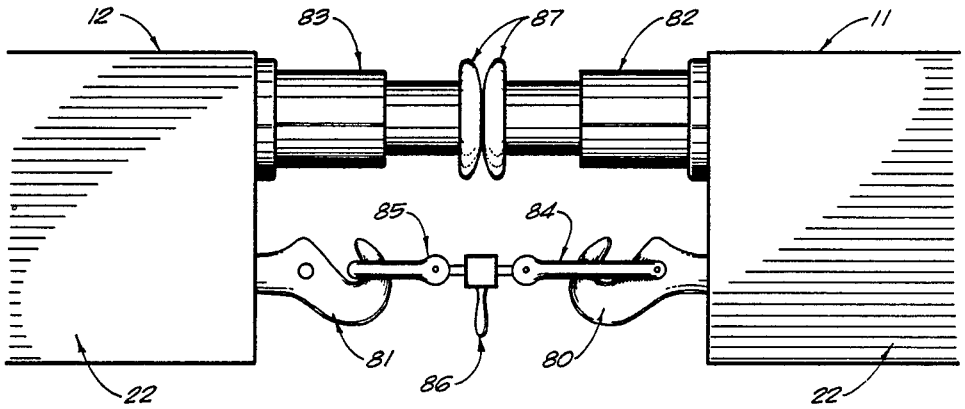
FIGS. 6 and 7 are diagrammatic views of another form of coupler for the hopper cars of the invention.
Figure 7:
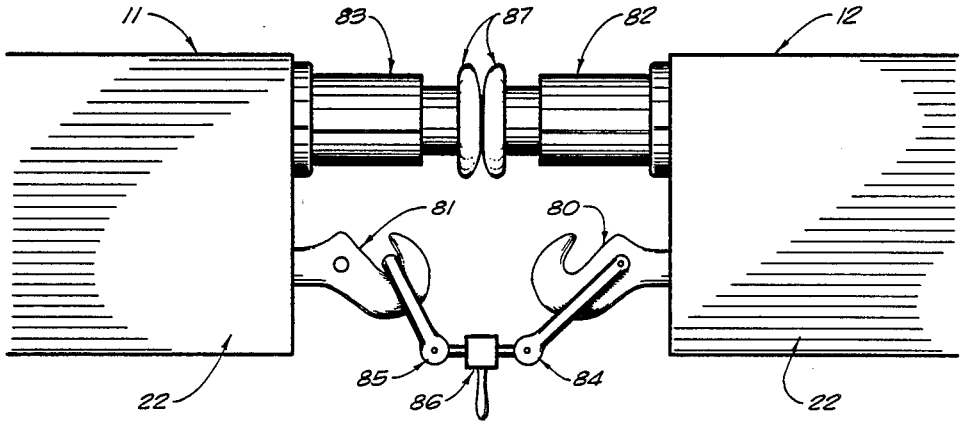

Another form of coupling system for the cars of the unit train is illustrated in FIGS. 6 and 7. This coupling assembly includes coacting chain draft assemblies 80 and 81 and coacting buffers 82 and 83 which are mounted on the confronting end faces of the side sills of adjacent cars. The chain link assembly 80 may consist of a hook mounted on the left hand side sill 22 of a hopper car, and associated chain links 84 and 85 connected by a turnbuckle 86 which may be manually operated to adjust the slack between adjacent cars. The chain link assembly 81, mounted on the right hand side sill of a coupled car, consists merely of a hook to which the chain link 85 is coupled. For a coupling system between adjacent cars, these chain link assemblies will be attached to both side sills. The buffers 82 and 83 are spring loaded compression buffers, for example; with the buffer 82 being mounted on the left side sill and the buffer 83 being mounted on the right side sill.

FIG. 6 illustrates the coupling system when a draft load exists between the adjacent cars. It will be seen that the coupling assembly 80, 81 is adjusted by means of the turnbuckle 86 so that the bumpers 87 of the two buffers 82 and 83 are in engagement with each other, with the buffers being placed in some compression. This draft condition of the coupler assembly would exist under draft load of the train, and also when the adjacent cars are on the outside of a curve in the track whether the train is moving or stationary. When the train is on a curve in the track, the coupler assembly on the inside of the curve must go slack, and this condition is illustrated in FIG. 7. By the same token, the buffers 82 and 83 must necessarily be more compressed than the buffers 82 and 83 on the opposite sides of the car. It will be seen then that at least one coupler assembly 80, 81 between adjacent cars is always in tension as illustrated in FIG. 6; and this limits the stretch of the train conveyor 40. The buffer assembly, 80, 81 then functions in the same manner as the slackless coupler assembly to limit the distance between the front end and the rear end of the unit train for all conditions of operation.

The above mentioned transfer conveyor 50 may have a length of 30 feet, for example, to enable the discharging of the material from the end of the train in a number of different fashions. One unloading procedure may be to deposit the material in a windrow alongside the track. The windrow might have a height of 10 feet for example, and the apex of the windrow must be sufficiently removed from the track to prevent the material from running onto the track. For this operation, the material would be deposited in the windrow while the train is moving slowly; and therefore a stretch of straight track must be sufficiently long to allow the train to move the necessary distance to unload the desired amount of the train load. For this operation, the hopper gates might be operated in sequence starting from either the front or the rear of the train or at some intermediate point to unload the desired amount of the train load.

A procedure for unloading the train while stationary may involve the use of a common type of portable stacking conveyor. Such conveyor may be powered by a suitable electric motor; and may be connected to the above described generating system of the trailer car 15 for power. Conceivably such a portable stacking conveyor could be carried with the selfunloading train of the invention; but more practically it would be transported to the unloading site by truck for example. Such a portable stacking conveyor may be positioned relative to the trailer car to enable the stacking of an entire train load for example into a pile 30 feet high and 40 away from the track. For a larger train load, adjacent piles may be made by moving the portable stacking conveyor and/or the train for example. The transfer conveyor 50 is preferably situated relative to the trailer car to enable discharge of material directly behind the trailer car, enabling use of the unit train to deposit ballast on the track for example.

What has been described are improved equipment and methods for the transport of bulk materials by rail, and for the rapid and efficient unloading of those bulk materials when the train arrives at its destination. A particular feature and advantage of the invention is that the equipment and method are functionally independent of any particular kind of unloading facility and independent of unloading time. The train can be unloaded by the train crew without the necessity for any unloading facilities or equipment or personnel at the unloading site.

Where aggregates are to be delivered to a highway construction site for example, advantage may be taken of the fact that railroads frequently parallel highway and the aggregates may be unloaded either on railroad right of way or highway right of way adjacent to the railroad and very close to the point of use of the aggregates. Additionally such aggregates may be delivered to that site weeks or even months ahead of the time that the aggregates will be used by the highway contractor.

A unit train as above described may be relatively small in terms of the number of hopper cars and overall train load; and this may be desirable to enable the train to be pulled by a relatively low powered locomotive. Where a large quantity of aggregates or materials are to be delivered to a particular destination, two or more such unit trains may be coupled together and either pulled by a larger locomotive or by multiple locomotives, one located at the front of the train and one located at the rear.

An important advantage of the invention is that such unit trains may be utilized to their maximum capacity, since there is no need for the train to remain on a siding for several days or longer waiting to be unloaded. An ancillary advantage to the receiver of the materials is that he has much more flexibility in arranging for the transfer of the materials from the rail siding to his storage or use location. He can schedule the use of his equipment much more efficiently, and need not be concerned about the cost of idle hopper cars sitting on a siding.

Another feature and advantage of the invention is that several different kinds or grades of material can be shipped on the same train. Since the hoppers are unloaded sequentially, a first kind of material may be loaded onto the front portion of the train, a second kind of material may be loaded onto a middle portion of the train, and a third kind of material may be loaded onto the rear portion of the train. If the train is unloaded in a windrow, the three different kinds of materials will be located in identifiable sections of the windrow. If the material is unloaded in piles by a portable stacking conveyor, by moving the conveyor or the train or both, the different kinds of material may be stacked in separate piles.

An important advantage of the invention is that it takes advantage of the efficiencies of rail transportation. It allows for twenty-four hour operation of the rail facilities and equipment while requiring no specialized unloading facility.

An overall feature and advantage of the invention is that it provides for maximum economy in the business of transporting bulk materials since it utilizes the rail transportation to maximum advantage, utilizes the equipment to the fullest extent by eliminating idle time, and utilizes the crew more efficiently.

A particular feature and advantage of a hopper car having the described side sill construction, is that the center of gravity of the car may be much lower than a car having a center sill construction. The side sill car construction together with the design of hoppers having walls inclined at slight angles to the vertical, enables the carrying of the loads in the hoppers having a much lower center of gravity. This enables the construction of hoppers having greater height to enable the hauling of lighter weight materials up to the full rate of capacity of the car structure, without exceeding the established height limits for the center of gravity of a loaded hopper car. Obviously, if the car can be loaded to full rated capacity, the efficiency of this method of transportation is increased. With the side sill car design described, the center of the supply run 41 of the conveyor belt can be as low as 28 inches above the top of the rail, compared with a height of 48 inches for that supply run in a hopper car with center sill construction.

While the preferred embodiments of the invention have been illustrated and described, it will be understood by those skilled in the art that changes and modifications may be resorted to without departing from the spirit and scope of the invention.

What is claimed is:

1. A self-unloading train for the transport of bulk commodities comprising:

a plurality of hopper cars coupled together, each of said hopper cars comprising:

a frame;

a plurality of wheels rotatably connected to said frame; and first and second side sills for carrying the load of said hopper cars, said first and second side sills affixed to said frame on opposite sides of said frame, said first and second side sills extending for the length of a hopper car, said first and second sills being joined to said frame exterior of said wheels of said hopper car, said frame arranged beneath the top of said wheels of said hopper car, said frame and said wheels defining an unobstructed longitudinal channel between said wheels and above the axles of said wheels; and train conveyor means connected to said first and second side sills, said train conveyor means positioned within said channel below the top of said wheels, said train conveyor means for transferring material along said plurality of hopper cars, said train conveyor means traversing said channel for the length of said plurality of hopper cars, said train conveyor means comprising:

a conveyor belt having a supply run and a return run:

a plurality of troughing idlers positioned within said channel, said troughing idlers located between said supply run and said return run of said conveyor belt, said supply run abutting the upper surface of said troughing idlers, said troughing idlers connected to said side sills, said return run of said conveyor belt being adjacent and above said axles; and tensioning means for taking up the slack in said conveyor belt during operation of said train conveyor means, said tensioning means engaging the interior of said conveyor belt between said supply run and said return run.

2. The self-unloading train as set forth in claim 1 said conveyor belt having a width less than the distance between said wheels of said hopper car.

3. A self-unloading train as set forth in claim 11 said discharge opening having a dimension parallel to said train conveyor means at least as long as eighty percent of the longitudinal top dimension of said hopper.

4. A self-unloading train as set forth in claim 12 said gate means comprising clam-shell type gates pivoted about axes parallel to said train conveyor means to assist in controlling the flow of said bulk material onto said train conveyor means.

5. A self-unloading train as set forth in claim 4 each of said clam-shell type gates being elongated, said gates having a long dimension parallel to said train conveyor means sufficient to span the length of said discharge opening.

6. A self-unloading train as set forth in claim 4, said clam-shell type gates opening to present a maximum opening width of at least sixty-five percent of the width of said train conveyor means.

7. A self-unloading train as set forth in claim 1 said conveyor belt comprising an endless belt.

8. A self-unloading train as set forth in claim 1 one of said plurality of hopper cars of said train having a standard coupler affixed to said frame to enable said train to be pulled by a standard locomotive.

9. A self-unloading train as set forth in claim 1 further comprising:

a trailer car connected to said plurality of hopper cars, said train conveyor means extending to said trailer car, said trailer car engaging an elevated portion of said train conveyor means at the end of said train conveyor means so as to allow said bulk material to be discharged to an adjacent conveyor.

10. A self-unloading train as set forth in claim 9 said adjacent conveyor mounted on said trailer car so as to receive said bulk material from said train conveyor means and to discharge said bulk material at selected points exterior of said trailer car.

11. The self-unloading train of claim 1, each of said hopper cars having a hopper formed therewithin, said hopper having walls inclined less than twenty-five degrees from vertical, said hopper having a discharge opening formed at the bottom of said hopper, said discharge opening for the gravity discharge of bulk material from said train conveyor means.

12. The self-unloading train of claim 11, said train further comprising:

gate means connected to said hopper at said discharge opening, said gate means operable selectively to discharge bulk material from said hopper to said train conveyor means.

13. The self-unloading train of claim 1, said troughing idlers being supported in a catenary manner within said channel.

* * * * *